United States Patent [19]

Schlottman

[11] 4,381,900

[45] May 3, 1983

[54] SELF PROPELLED REACHING-TYPE MOBILE LOADER

[76] Inventor: Glen N. Schlottman, 18735 Martinique Dr., Houston, Tex. 77058

[21] Appl. No.: 233,636

[22] Filed: Feb. 12, 1981

[51] Int. Cl.[3] ..... E02F 3/72

[52] U.S. Cl. ..... 414/718; 414/692; 414/715; 414/728

[58] Field of Search ..... 414/622, 718, 728, 690, 414/692, 697, 714, 715; 180/41; 280/6.11, 111, 707

[56] References Cited

U.S. PATENT DOCUMENTS

| | | | |
|---|---|---|---|
| 3,370,730 | 2/1968 | Fielding | 280/111 X |
| 3,910,440 | 10/1975 | Holtkamp et al. | 414/718 X |
| 3,967,744 | 7/1976 | Goyarts | 414/718 X |
| 4,082,197 | 4/1978 | Stedman | 414/718 X |
| 4,142,308 | 3/1979 | Brandtjen | 414/718 X |
| 4,266,819 | 5/1981 | Pemberton | 414/622 X |
| 4,306,832 | 12/1981 | Schmiesing | 414/728 X |

FOREIGN PATENT DOCUMENTS

| | | | |
|---|---|---|---|
| 827502 | 11/1969 | Canada | 414/622 |

*Primary Examiner*—Robert J. Spar
*Assistant Examiner*—Terrance L. Siemens
*Attorney, Agent, or Firm*—Neal J. Mosely

[57] ABSTRACT

A self propelled reaching type mobile loader includes a mobile vehicle which has an articulated body and frame and self leveling wheels. The front portion has a supporting frame with a cab enclosing the front end thereof and has a suitable motor means for operating the vehicle and loading components. A pair of pivot supports are laterally spaced on the frame adjacent the top of the cab and support a pair of pivoted supporting lever members each having a pair of arms rigidly extending at an angle to each other. One of the arms on each of the supporting lever members is supported for pivotal movement on the pivot supports and has an initial position extending along the top of the cab with the angularly extending arm extending substantially vertically in front of the cab. A pair of supporting boom members are supported on each of the angularly extending arms of the supporting lever members and movable longitudinally thereof. A load carrying carriage is supported on the lower ends of the boom members. The load carrying carriage includes pivoted members movable to clamp or secure the load carried thereon. Actuating means comprising fluid operated cylinders are provided for moving the various components. A fluid operated cylinder operates the pivoted supporting lever members to pivot the boom members between a vertical position and an elevated position. Another cylinder extends and retracts the boom members in any selected pivotal position. Other cylinders pivot the supporting carriage and operate the load securing members.

17 Claims, 6 Drawing Figures

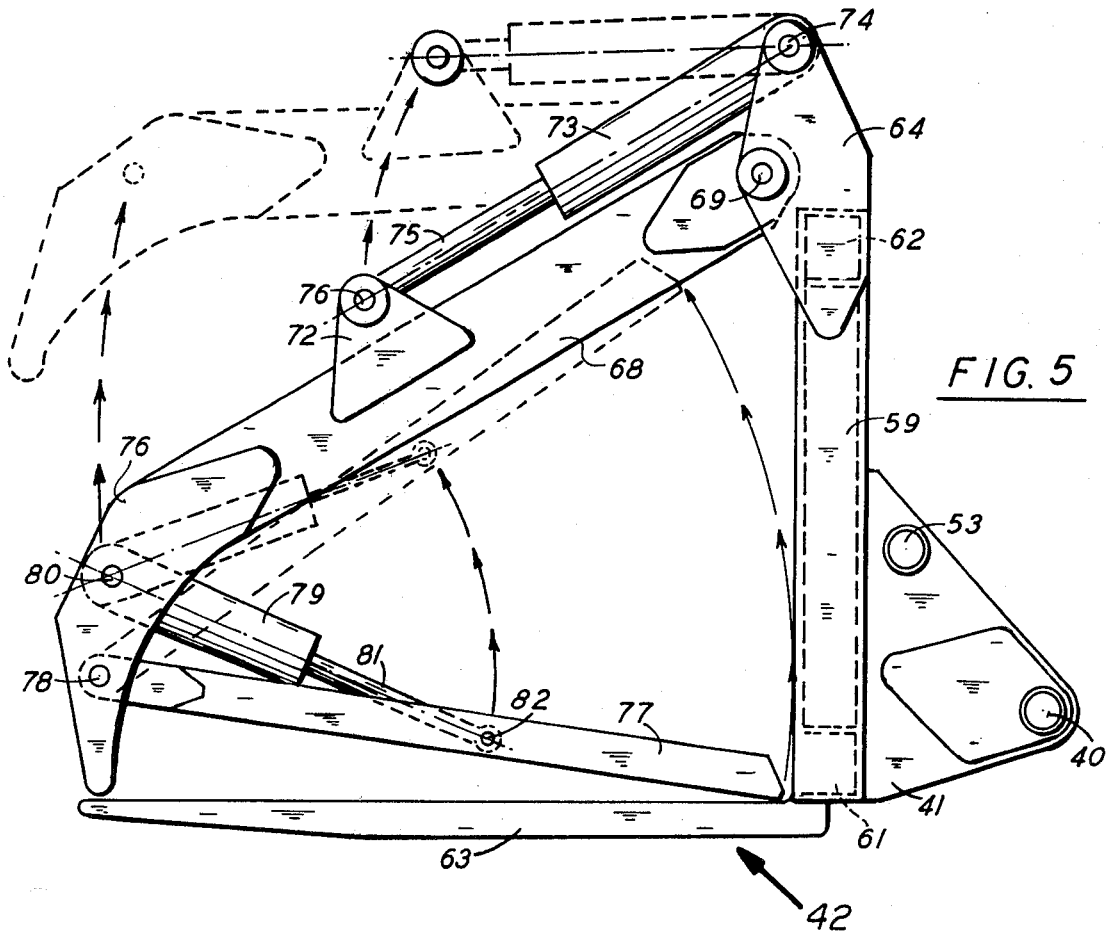
FIG. 5
FIG. 6
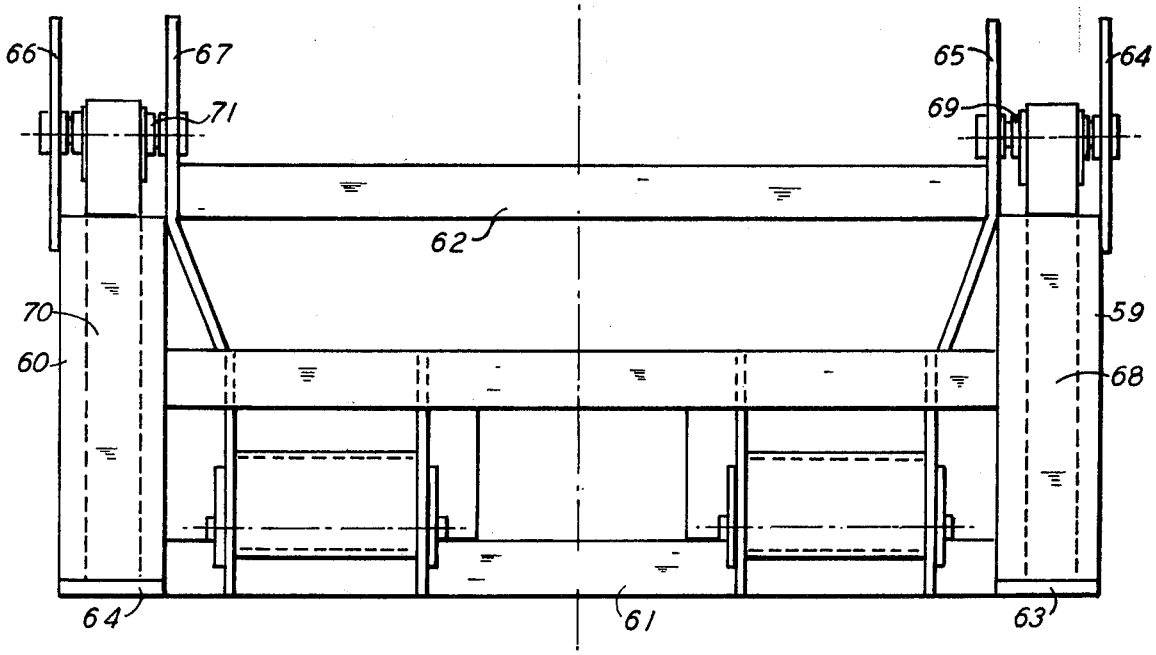

SELF PROPELLED REACHING-TYPE MOBILE LOADER

BACKGROUND OF THE INVENTION

1. Field of the Invention

This invention relates to new and useful improvements in self propelled mobile loaders and more particularly to front reaching loaders.

2. Description of the Prior Art

Lull U.S. Pat. No. 3,327,879 discloses a mobile, self-propelled front end loader including extensible supporting arms or booms for a load supporting carriage.

Mindrum U.S. Pat. No. 2,990,072 discloses mobile vehicle with an extendable lift mechanism operated by hydraulic rams or the like.

Card U.S. Pat. No. 3,045,853 discloses a pivoted fork lift apparatus on a tractor or truck or the like.

Kampert et al. U.S. Pat. No. Re. 26,635 (of U.S. Pat. No. 3,237,790) discloses an articulated four wheel drive earthworking vehicle with hydraulic lift and extension mechanisms.

Noller U.S. Pat. No. 3,738,502 discloses a self propelled vehicle mounted lift mechanism with self leveling wheels.

Geis et al. U.S. Pat. No. 3,937,339 discloses a vehicle with self leveling wheels and a hydraulically operated lift mechanism.

Satterberg et al. U.S. Pat. No. 4,193,505 discloses a hydraulically operated crane with an extendable boom arrangement.

SUMMARY OF THE INVENTION

One of the objects of this invention is to provide a new and improved vehicle-mounted, self-propelled mobile loader.

Another object of the invention is to provide a mobile loader having means for supporting a load immediately in front of a supporting vehicle and means to elevate and to extend the supported load.

Another object of the invention is to provide a self propelled mobile loader having means to lift and extend a supported load and to clamp a load in a supporting carriage.

Still another object of the invention is to provide a self propelled mobile loader with lifting and extending means including clamping means combined with means to tilt a supporting carriage.

Other objects of this invention will become apparent from time to time throughout the specification and claims as hereinafter related.

These and other objectives of the invention are provided in a self propelled reaching type mobile loader including a mobile vehicle which has an articulated body and frame and self leveling wheels. The front portion has a supporting frame with a cab enclosing the front end thereof and has a suitable motor means for operating the vehicle and loading components. A pair of pivot supports are laterally spaced on the frame adjacent the top of the cab and support a pair of pivoted supporting lever members each having a pair of arms rigidly extending at an angle to each other. These lever members are substantially bell crank levers of the third order. One of the arms on each of the supporting lever members is supported for pivotal movement on the pivot supports and has an initial position extending along the top of the cab with the angularly extending arm extending substantially vertically in front of the cab. A pair of supporting boom members are supported on each of the angularly extending arms of the supporting lever members and movable longitudinally thereof. A load carrying carriage is supported on the lower ends of the boom members. The load carrying carriage includes pivoted members movable to clamp or secure the load carried thereon. Actuating means comprising fluid operated cylinders are provided for moving the various components. A fluid operated cylinder operates the pivoted supporting lever members to pivot the boom members between a vertical position and an elevated position. Another cylinder extends and retracts the boom members in any selected pivotal position. Other cylinders pivot the supporting carriage and operate the load securing members.

BRIEF DESCRIPTION OF THE DRAWINGS

FIG. 5 is a detail view in side elevation of the load supporting carriage and the operating mechanism for securing a load therein.

FIG. 6 is an end view of the load supporting carriage shown in FIG. 5.

DESCRIPTION OF A PREFERRED EMBODIMENT

Figure 1:
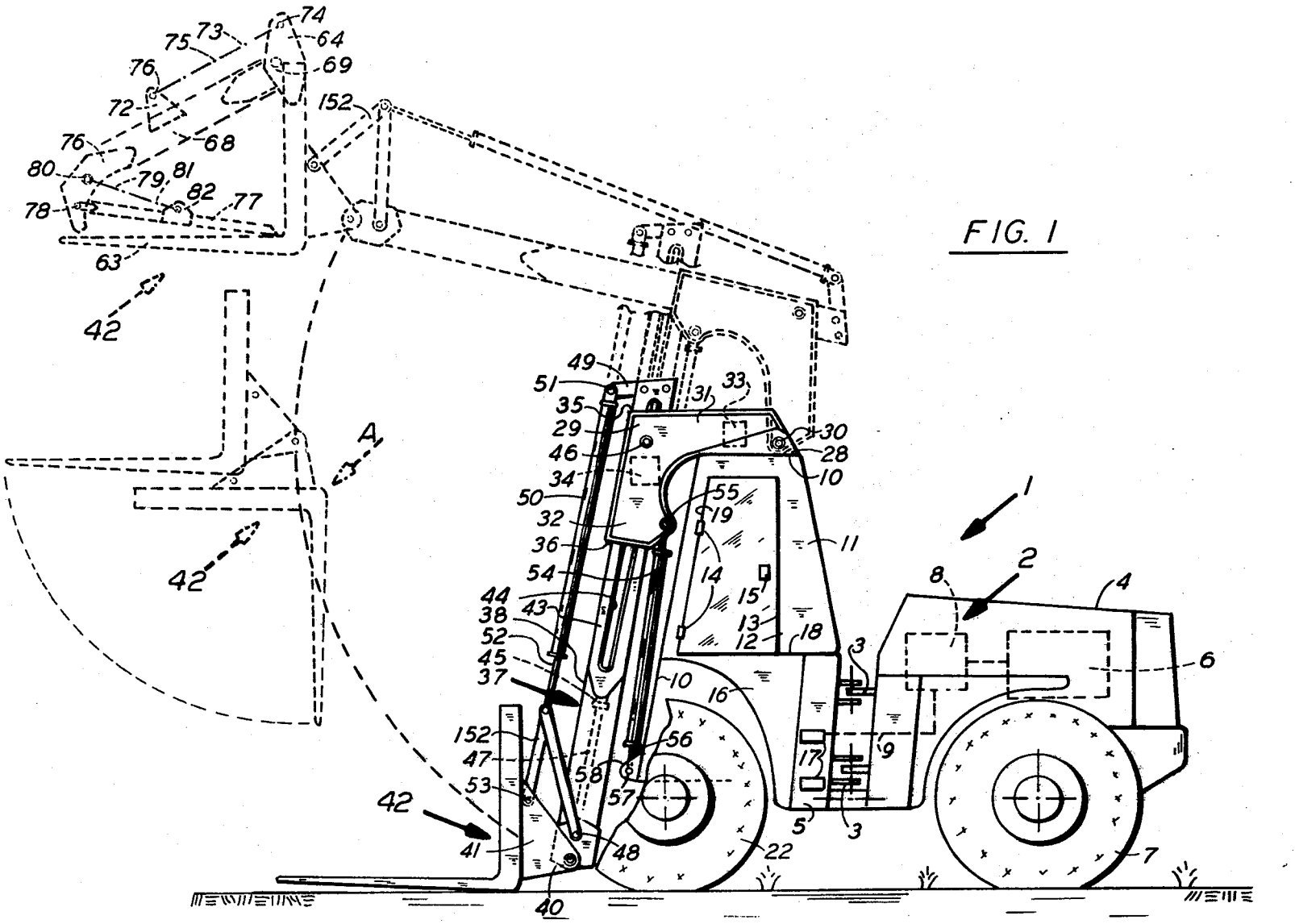
FIG. 1 is a view in side elevation of a self propelled reaching type mobile loader representing a preferred embodiment of the invention and showing, in dotted line, part of the mechanism in a lifted and extended position.
Figure 2:
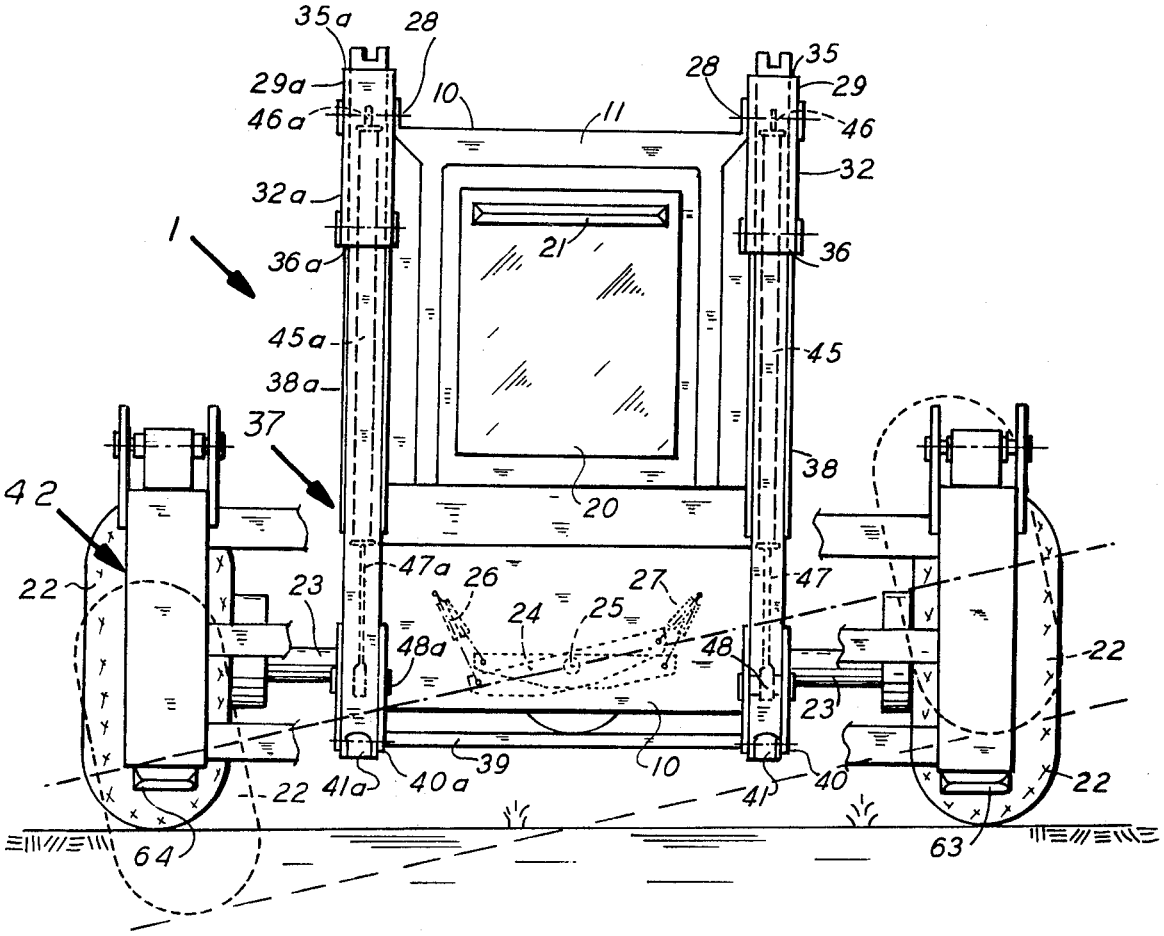
FIG. 2 is a view in front elevation of the vehicle and loader.
Figure 3:
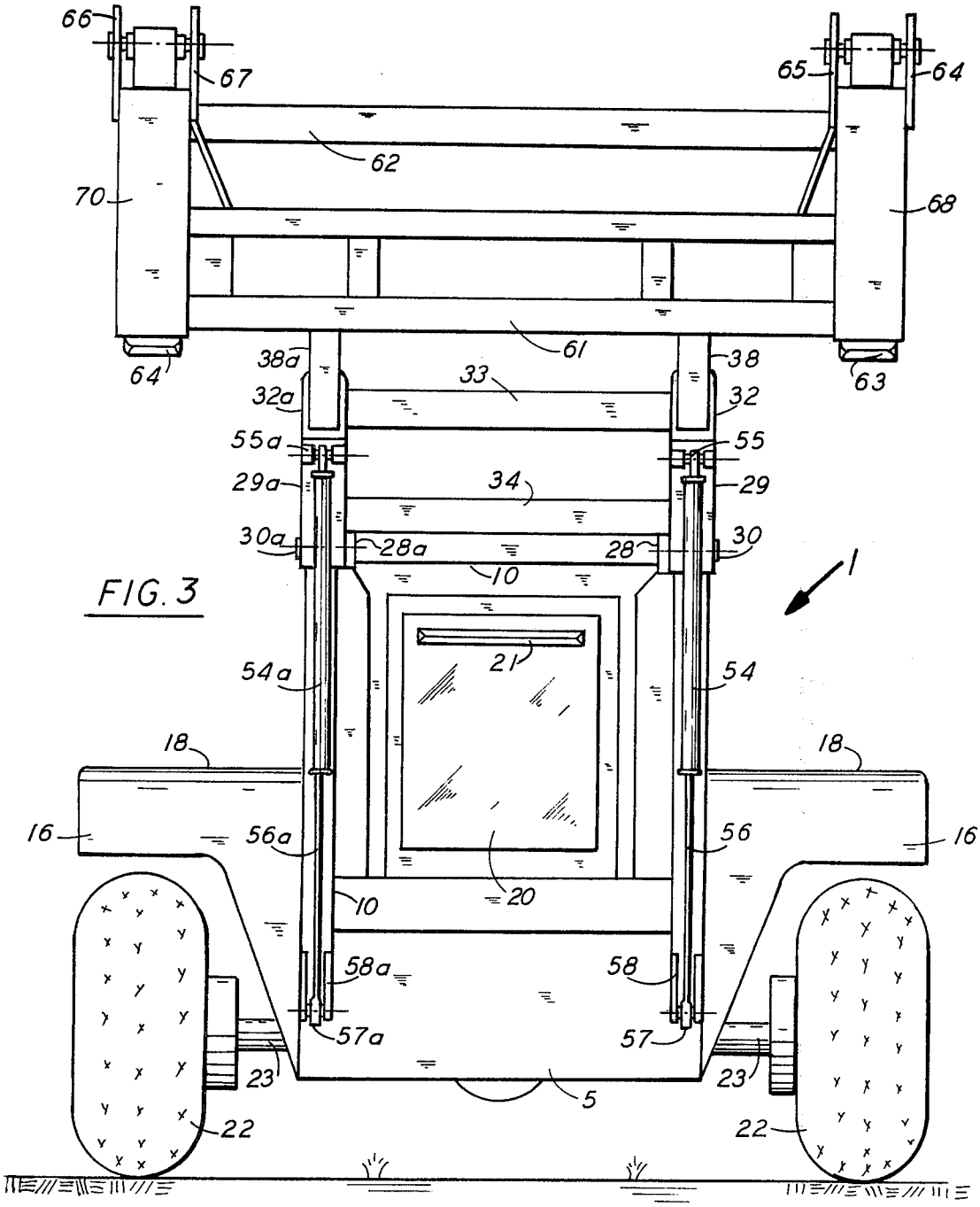
FIG. 3 is a view in front elevation of the vehicle and loader operated to an elevated position.
Figure 4:
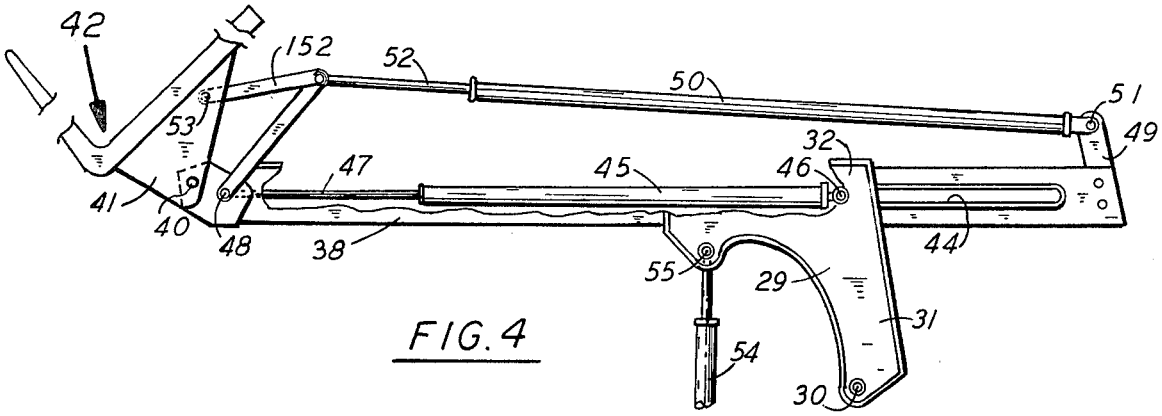
FIG. 4 is a detail view, partially broken away, of the load lifting pivoting lever and boom extending mechanism.

Referring to the drawings by numerals of reference, and particularly to FIGS. 1–3, there is shown a self propelled mobile loader 1 comprising a mobile vehicle 2 with an articulated construction as indicated at 3. Vehicle 2 is comprised of rear body portion 4 and front body portion 5 which are connected by articulated joint 3, as previously noted. Rear body portion 4 encloses an engine or motor 6 shown schematically in dotted line and which drives the rear wheels 7 of the vehicle.

Motor or engine 6 also drives the hydraulic pump or motor 8 which is also shown schematically in dotted line. Hydraulic motor 8 is connected by one or more flexible lines 9 (shown in dotted line) extending to the front body portion 5 of vehicle 2. The hydraulic lines are connected to a conventional control panel containing a plurality of hand operated control valves each being connected to various hydraulic cylinders used in actuation of various components. The connections from line 9 onto the various cylinders is not shown inasmuch as the illustration of these hydraulic lines would unduly complicate the illustration of the mechanical components of the apparatus.

Front body portion 5 of vehicle 2 has a supporting frame 10 with a cab 11 enclosing the same. Cab 11 has side door openings 12 on each side. A transparent door or window 13 (of heavy thickness LEXAN plastic) is hinged at 14 to each door opening 12 and is opened and closed by handle 15. Fenders 16 extend from each side of the front body portion 5 over the front wheels. Each of the fenders 16 is provided with steps 17 for climbing to the top fender ledge 18 for entering the door 12 to cab 11.

Cab 11 has a sloping, nearly vertical front wall 19 supporting a flat windshield 20, preferably of heavy thickness LEXAN plastic, (in FIG. 2). Windshield 20 optionally includes a prism 21 positioned the upper edge thereof for viewing downwardly over an obstacle positioned immediately in front of the windshield. Frame 10 also supports the front wheels 22 of vehicle 2. Wheels 22 are supported on axle 23 which is carried on supporting member 24 supported on pivot 25. The ends of supporting member 24 are connected to hydraulic cylinders 26 and 27 which provide for automatic angular adjustment of wheels 22 as indicated in dotted line in FIG. 2. Cylinders 26 and 27 provide for automatic leveling of vehicle 2 when positioned on or passing over an uneven surface by introduction of hydraulic fluid into one cylinder and withdrawal of fluid from the other. Wheels 7 are supported in the same manner as wheels 22 and are adjustable by another pair of hydraulic cylinders 26 and 27 (not shown). This adjustment of the hydraulic fluid in cylinders 26 and 27 may be done automatically using conventional equipment or may be done manually by use of separate hydraulic pumps or hydraulic control valves.

At the top of cab 11, on supporting frame 10, there are provided a pair of bosses or pivot supports 28 and 28*a*. A pair of pivoted supporting members 29 and 29*a* have pivot connections 30 and 30*a* to pivot supports 28 and 28*a*, respectively. Pivoted supporting members 29 and 29*a* are rigid, L-shaped lever members having an angular shape corresponding substantially to a bell crank lever of the third order. L-shaped pivoted members 29 and 29*a* each comprises a pair of arms 31 and 32 (and 31*a* and 32*a*) rigidly extending at an angle to each other. Arm 31 is pivotally connected to pivot support 28 and has an initial position extending along the top of cab 11 with angularly extending arms 32 extending substantially vertically in close proximity to the front wall 19 of cab 11. Laterally extending supports or struts 33 and 34 are secured to and extend between pivoted supporting members 29 and 29*a* to provide a rigid interconnection therebetween for conjoint operation thereof.

Pivoted supporting members 29 and 29*a* are hollow and have openings 35 and 36 (and 35*a* and 36*a*) defining an open passage along the arms 32 and 32*a* thereof. A lifting boom 37 is supported in pivoted supporting members 29 and 29*a*. Boom 37 consists of a pair of boom members 38 and 38*a* which are interconnected at the bottom ends by a rigid laterally extending supporting member 39. Boom 37 is therefore of a U-shaped construction consisting of boom members 38 and 38*a* and cross-support 39 which provides for conjoint movement of the boom members.

At this point, it should be noted that pivot or lever member 29 and boom member 38 are shown in substantial detail in FIGS. 1–4. The other pivot or lever member 29*a* and boom member 38*a* are shown in FIGS. 2 and 3 but all details are not shown in those views. It should be understood therefore that pivoted supporting member 29*a* and boom member 38*a* are substantially identical to pivoted supporting member 29 and boom member 38 in all respects and similar parts or features will be given the same reference numerals with a suffix "a" added. If a given feature or component is not shown, it can be assumed that a similar view of pivoted supporting member 29*a* and boom member 38*a* would have the same feature.

Boom members 38 and 38*a* are elongated members which are rectangular and hollow in cross section. A preferred construction of these members utilizes hollow extruded or welded steel tubing of rectangular cross section. An alternate construction utilizes a hollow rectangular tube which is fabricated. The rectangular tubing is preferably stiffened longitudinally by longitudinally extending angle steel members, not shown, secured on the inside of the tube at the four corners thereof, as by welding, and extending longitudinally for substantially the entire length of the tube. The openings 35 and 36 on pivoted supporting member 29 and openings 35*a* and 36*a* on lever member 29*a* are rectangular, identical in size and shape, and are of substantially the same size and shape as the cross section of boom members 38 and 38*a*. The openings 35 and 36 (and 35*a* and 36*a*) are of a size providing a relatively tight sliding fit for boom members 38 and 38*a* and guide the boom for sliding movement therein. The lower end of boom member 38 is connected by a pivot pin 40 to a supporting bracket 41 on a carriage 42 for supporting a load to be moved by the apparatus. Boom member 38 has a reinforcing plate 43 on one side and a corresponding (unnumbered) reinforcing plate on the opposite side. Reinforcing plate 43, and the corresponding plate on the opposite side, are provided with a longitudinally extending slot 44 which extends almost to the other end of boom member 38.

A hydraulically actuated cylinder 45 is positioned longitudinally inside boom member 38 and is connected by a pin connection 46 to pivoted supporting member 29. Pin connection 46 extends through the slots 44 on opposite sides of boom member 38 so that boom member 38 may have sliding movement for the entire length of slot 44. Cylinder 45 has an operating piston 47 which is connected by a pin connection 48 to the lower end of boom member 38. Extension or contraction of piston 47 by cylinder 45 is effective to slide boom member 38 longitudinally in relation to arm 32 of pivoted supporting member 29. This sliding movement can be accomplished by any angular position or setting of pivoted supporting member 29.

At the upper end of boom member 38 there is provided a supporting bracket 49. A hydraulically actuated cylinder 50 is supported on bracket 49 by a pin connection 51 and has an actuating piston 52 connected by linkage 152 to a pin connection 53 to bracket 41 on load carrying carriage 42. Extension or retraction of piston 52 by hydraulic cylinder 50 causes angular rotation of supporting bracket 41 and carriage 42. This actuation can be effected in any angular position of pivoted supporting member 29 and any extended or retracted position of boom member 38. A hydraulic cylinder 54 is provided for lifting boom members 38 and 38*a* by rotation of pivoted supporting members 29 and 29*a*. Hydraulic cylinder 54 is connected by a pinned connection 55 to pivoted supporting member 29 and 29*a* and provided with an operating piston 56 connected by a pinned connection 57 to a bracket 58 on supporting frame 10. Extension of piston 56 by hydraulic cylinder 54 is operable to move pivoted supporting member 29 to rotate the same to an elevated position as shown in dotted line in FIG. 1 or as shown in full line in the front end view shown in FIG. 3.

As previously noted, the lower ends of boom members 38 and 38*a* are pivotally secured by pin connections 40 and 40*a* to brackets 41 and 41*a* on load lifting carriage 42. The carriage 42 is shown in more detail in FIGS. 5 and 6 and some details are shown in FIG. 1 (in dotted line) and 3. Carriage 42 consists of a rear vertically extending frame of rectangular tubular steel members consisting of vertical members 59 and 60 and horizontally extending members 61 and 62. Brackets 41 and 41*a* are supported at the rear of the vertically extending frame, on members 59, 60 and 61. A pair of L-shaped supporting tines 63 and 64 are secured to and extend forward from tubular frame member 61 with the vertical portion of the tines extending upward and secured in vertical support members 59 and 60.

A pair of supporting plate members 64 and 65 are secured on opposite sides of the top of vertically extending frame member 59. A similar pair of plate members 66 and 67 are supported on opposite sides of the top of frame member 60. A pivoted clamping member 68 is pivotally connected as at 69 to supporting plates 64 and 65. A similar clamping member 70 is pivotally connected as at 71 to supporting plates 66 and 67. Pivoted arm 68 is provided with brackets 72. The hydraulic cylinder 73 is connected to supporting plates 64 and 65 by a pinned connection 74. Hydraulic cylinder 73 has an actuating piston 75 which is connected by a pinned connection 76 to brackets 72. A similar hydraulic cylinder and connections therefore are provided for clamping member 70 but are not shown. The extension of piston 75 by hydraulic cylinder 73 causes clamping member 68 to clamp against the end of tine 63. The retraction of piston 75 by hydraulic cylinder 73 causes clamping member 68 to rotate upward as indicated in dotted line in FIG. 6.

The lower end of clamping member 68 is provided with a pair of plate members 76 which provide a pivotal support for a further clamping member and the hydraulic cylinder for actuating the same. A clamping member 77 is pivotally connected as indicated at 78 on supporting plates 76. Hydraulic cylinder 79 is provided for actuating clamping member 77. Hydraulic cylinder 79 is pivotally connected on supporting plates 76 as indicated at 80 and has an actuating piston 81 which is pivotally connected pin connection 82 to clamping member 77. Retraction of piston 81 by cylinder 79 is effective to rotate clamping member 77 upward as indicated in dotted line. Extension of piston 81 is effective to rotate clamping member 77 downward. An identical set of clamping members and actuating piston, equivalent to clamping member 77 and cylinder 79 is provided for the other clamping arm 70 but is not shown.

OPERATION

The apparatus described above is a self propelled reaching type mobile loader. This loader is of general application and can be used interchangeably with a forklift for some purposes. This mobile loader, however, is specially designed for handling pipe and other long narrow symmetrical objects. The loader is designed so that a load can be carried in a lowered position very close to the front of the vehicle cab. It is also designed so that the lifting carriage can pick up a load at some distance in front of the cab and carry the load in an elevated or a lowered position immediately in front of the cab.

As previously noted, the mobile loader is self propelled and consists of a two-part vehicle 2 (FIG. 1) having an articulated connection between the front body portion 5 and rear body portion 4. The engine or motor 6 in the rear body portion 4 drives the wheels 7 and/or 22 and also drives hydraulic pump or motor 8 which provides hydraulic fluid under pressure for operating the various hydraulic cylinders for moving the component parts of the loader. The articulated structure of the vehicle 2 permits the vehicle to operate over uneven surfaces and the hydraulic automatic leveling cylinders 26 and 27 are operable to adjust the position of the front wheels 22 to maintain the apparatus in a vertical position.

The operator enters the vehicle by climbing steps 17 to the top ledge 18 of fender 16 on either side of the vehicle. The operator enters through doorway 12 by opening the hinged door or window 13 by means of handle 15. Inside the cab 11, there are provided conventional controls (not shown) for starting and stopping the motor or engine 6 and for moving the vehicle and steering it. There are also provided conventional controls (not shown), in the form of control levers for hydraulic valves which control the application of pressurized hydraulic fluid from hydraulic motor or pump 8 to selected hydraulic cylinders for operation various components of the loader.

In the position shown in full line in FIG. 1, hydraulic cylinder 45 and its actuating piston 47 is operable upon retraction or upon extension to raise or lower the boom 37 and carriage 42 which carries a load positioned thereon. Starting from this position, the apparatus can be used for lifting loads immediately in front of the equipment in the manner of an ordinary forklift.

The operation of hydraulic cylinder 54 and piston 56 is effective to pivot the pivoted supporting members 29 and 29*a* between the full line and the dotted line positions shown in FIG. 1. The pivotal movement of pivoted supporting members 29 and 29*a* about pivot point 30 is effective to pivot the lifting boom 37 as indicated by the dotted circular arc shown in FIG. 1. The extension or retraction of boom 37 by hydraulic cylinder 45 and piston 47 operating on boom members 38 and 38*a* is effective to lift the boom 37 and carriage 42, when in the nearly vertical position shown in full line in FIG. 1, and is effective to move boom 37 and carriage 42 forward or rearward of the apparatus when supported in an elevated position as shown in dotted line in FIG. 1. This sliding movement of boom 37 in pivoted supporting members 29 and 29*a* by hydraulic cylinder 45 and 45*a* provides the forward and rearward movement of load carrying carriage 42 to provide a substantial forward reach for the carriage and to provide for the retraction of the loaded carriage to support the same in an elevated position adjacent to the top cab 11 and to permit the load to be moved to a lowered position immediately in front of cab 11.

The operation of hydraulic cylinders 50 and 50*a* and pistons 52 and 52*a* is effective to move linkages 152 to pivot supporting brackets 41 and 41*a* for load carrying carriage 42. The extension of pistons 52 and 52*a* is effective to pivot load carrying carriage 42 to point the same downward as indicated in dotted line at the intermediate position A in FIG. 1. The extension of operating pistons 52 and 52*a* is effective to pivot load carrying carriage 42 between a horizontal and a vertical position at any intermediate point between the solid line orientation of the loader in FIG. 1 and the uppermost dotted line orientation shown in FIG. 1, so long as there is sufficient vertical clearance from the ground or any other object to permit such pivotal movement.

In any position where carriage 42 is to pick up a load, piston 75 may be retracted by cylinder 73 to cause clamping member 68 to pivot upward. Pivoted clamping member 77 is normally maintained in a position retracted into clamping member 68 as indicated in dotted line in FIG. 5. The extension of pistons 81 by hydraulic cylinder 79 is effective to pivot clamping member 77 downward against tines 63 to clamp smaller loads in position.

As previously noted, the apparatus is particularly useful and designed for picking up pipes and other small narrow symmetrical elongated members, such as lumber. The apparatus is particularly useful in its ability to reach over and into storage compartments to pick up objects supported therein. It is also characterized by a more extensive forward reach than other forward reaching mobile loaders and by its ability to carry a load in an elevated position either extended in front of the supporting vehicle or retracted to a position immediately above the cab.

To illustrate the improved operating characteristics of this reaching type mobile loader, its mode of operation will be described for several problem situations. In the first situation, assume that a quantity of pipe is to be picked up from a storage position at ground level and loaded onto an elevated support. In this situation, the vehicle 2 would be moved to position the supporting tines 63 under the load of pipe to be lifted from the ground level. In this position, the clamping members 68 and 77 would be rotated upward to allow for entry of the pipe into supporting relation with tines 63. Cylinders 73 are then operated to pivot clamping members 68 into clamping relation to hold the pipe in position on supporting carriage 42. If necessary, cylinders 79 are actuated to use the auxiliary clamping members 77.

If there is adequate space in front of the loader, the pistons 56 and **56*a* are operated by hydraulic cylinders 54 and 54*a* to pivot the pivotal supporting members 29 and 29*a* to rotate the supporting boom 37 to an elevated position. The vehicle 2 can then be moved to position carriage 42 over the support where the load is to be placed. The carriage 42 is then tilted forward and cylinders 73 and 73*a* are operated to pivot clamping members 68 and 68*a*** upward to allow the load to be discharged to the place of support. If the apparatus were being used to pick up a load from an elevated place of support and lower the same to ground level, the sequence of operation would be in the reverse direction from that just described.

In another situation, assume that a load is to be lifted from ground level and discharged to an elevated support, as just described, but there is insufficient clearance for the boom 37 to be swung in the dotted arc shown in FIG. 1. In this situation, the load would be picked up as described above. Then, hydraulic cylinders 45 and **45*a* are actuated to move boom members 38 and 38*a* upward through the pivoted supporting members 29 and 29*a* until the load is supported in an elevated position closely in front of cab 11. At this position, hydraulic cylinders 54 and 54*a* are operated to cause supporting members 29 and 29*a* to pivot to an elevated position with the carriage 42, and the load carried thereon, positioned in an elevated position immediately in front of and above cab 11. From this position, hydraulic cylinders 45 and 45*a* are then operated to extend boom members 38 and 38*a* to move carriage 42**, and the load carried thereon, to the point where it is to be unloaded.

In another situation, assume that a quantity of pipe is to be picked up from an open top railway car or similar storage bin. In this situation, there may be insufficient maneuvering room for ordinary mobile loaders and this apparatus is particularly effective. In this situation, the hydraulic cylinders 45 and **45*a* are operated to fully retract boom members 38 and 38*a* to move carriage 42 to a raised position. Cylinders 54 and 54*a* are actuated to pivot the pivoted supporting members 29 and 29*a*** to an elevated position.

Once in this elevated position, the vehicle is positioned adjacent the side of the railway car or storage bin from which the pipe is to be unloaded. The hydraulic cylinders 45 and **45*a* are actuated to extend boom members 38 and 38*a* forward from the elevated position of pivoted supporting members 29 and 29*a* while cylinders 54 and 54*a* are retracted to cause pivotal supporting members 29 and 29*a* to pivot downward. This movement brings supporting boom 37 and carriage 42** downward into the open top of the railway car or storage bin.

The pistons 50 and **50*a* are operated to rotate or pivot the load carrying carriage 42 into a downwardly facing position as shown in dotted line at the intermediate position A in FIG. 1. The clamping arms 68 and 77 are simultaneously operated by their actuating cylinders 73 and 79 to an open position. The carriage 42 therefore has assumed the position of an open hand or claw reaching downward toward the load which is to be picked up. Carriage 42 can be moved downward over a load of pipe to be picked up and cylinders 73 and 79 actuated to move clamping members 68 and 77 into clamping relation with the load. These supporting members are effective to pull or draw a quantity of pipe onto supporting tines 63** and to clamp the load in place.

From this position, hydraulic cylinders 45 and **45*a* are retracted and pivotal supporting members 29 and 29*a* pivoted upward to raise the load out of the open top railway car or bin. At the same time, cylinder 50 is actuated to pivot carriage 42 to the normal horizontal position. After the load reaches the elevated position, shown in dotted line in FIG. 1, above the railway car or storage bin, supporting boom 37 is retracted by hydraulic cylinders 45 and 45*a* to a position adjacent to the top of vehicle cab 11. If there is sufficient room, the supporting members 29 and 29*a* may be pivoted downward to a position adjacent the front of cab 11 and the boom 37** lowered to a desired level. If there is insufficient room, the vehicle may be backed off until room is available to allow the load to be lowered.

From the foregoing description of assembly and operation of this apparatus, it is seen that there is provided herein a reaching type mobile loader which is capable of operation over uneven terrain and which can perform a variety of loading and unloading functions in a manner superior to mobile loaders shown in the prior art. The equipment is particularly advantageous in its ability to operate under cramped operating conditions. This is accomplished by the particular construction of the pivoted supporting members 29 and **29*a* and the U-shaped supporting boom 37 which allows a load to be lifted and lowered in a position very close to the front of the vehicle cab and to be extended and retracted, in an elevated position, to a position which is substantial distance in front of the vehicle cab. The combination of the pivotal and reaching and retracting movements, together with the pivotal control of the supporting carriage 42 and the independent control of clamp members 68 and 77**, allows the apparatus to reach over obstacles and pick up pipe or other loads from open top storage bins or railway cars.

While this invention has been described fully and completely with emphasis upon a single preferred embodiment, it should be understood that within the scope of the appended claims, the invention may be practiced otherwise than as specifically described herein.

I claim:

1. A self propelled reaching type mobile loader including a mobile vehicle having a supporting frame at the front end thereof, with a cab enclosure, and motor means for operating the same, comprising a pair of laterally spaced pivot supports on said frame adjacent the top of said cab, a pair of pivoted supporting members each having an L-shaped construction comprising a pair of arms rigidly extending at an angle to each other, one of the arms on each of said supporting members being supported for pivotal movement on said pivot supports and having an initial position extending substantially horizontally along the top of said cab with the angularly extending arm extending substantially vertically downward a short distance from the top of and in front of said cab, a pair of supporting boom members supported one on each of said angularly extending arms of said supporting members, movable longitudinally thereof, and having a substantially fully vertically extended position in said initial position of said pivoted supporting members, load carrying supporting means supporting on the lower ends of said boom members, whereby said load carrying supporting means are positioned adjacent to the ground level on which the mobile vehicle is resting with said pivoted supporting members in said initial position and said boom members in said substantially fully vertically extended position, first actuating means connected to said pivoted supporting members for moving the same to pivot said boom members from said substantially vertical position to a predetermined elevated position, and second actuating means supported on said pivoted supporting members for extending and retracting said boom members longitudinally of said angularly extending arms in said initial position or in any pivoted position of said pivoted supporting members whereby a load may be lifted vertically in said initial position and extended horizontally from a fully pivoted position.

2. A mobile loader according to claim 1 in which said first actuating means is operable to position said supporting members in any selected position from said vertical boom-supported position to said elevated boom-supporting position, and said second actuating means is operable to selected extended or retracted positions in any selected pivotal position of said pivoted supporting members.

3. A mobile loader according to claim 1 including means supporting said load supporting means for pivotal movement on said boom members, and third actuating means supported on said boom members for pivoting said load supporting means.

4. A mobile loader according to claim 1 in which said load supporting means includes means for securing a load thereon, and fourth actuating means supported on said load supporting means for actuating said load securing means.

5. A mobile loader according to claim 1 in which said said pivoted supporting members are interconnected for conjoint movement.

6. A mobile loader according to claim 1 or 5 in which boom members are interconnected at their bottom ends to form a substantially U-shaped structure operable as a unitary supporting boom slidable supported in said pivoted supporting members.

7. A mobile loader according to claims 2, 3 or 4 in which all of said actuating means are actuated by said vehicle motor means.

8. A mobile loader according to claim 1 in which said vehicle comprises a longitudinally articulated body and self leveling wheels.

9. A mobile loader according to claim 1 in which said pivot supports are positioned at the top rear of said cab, and said second actuating means is extendable to extend said boom members and said load supporting means a substantial distance in front of said cab and retractable to position said boom members with said load supporting means adjacent to the front of said cab.

10. A mobile loader according to claims 2, 3 or 4 in which all of said actuating means are fluid actuated cylinders.

11. A mobile loader according to claim 3 in which said load supporting means comprises a carriage having a pair of forwardly extending tines, a pair of vertical supports for said tines, and supporting brackets carried by said vertical supports operable to be secured to said boom members and to said third actuating means.

12. A mobile loader according to claim 11 including load securing members pivotally supported on said vertical supports and movable into and out of securing relation to said tines, and a fourth actuating means supported on said vertical supports and operable to move said load securing members.

13. A mobile loader according to claim 1 in which said first actuating means comprises at least one fluid actuated cylinder supported at one end on the lower portion of said frame and operatively connected at the other end to one of said pivoted supporting members, and said second actuating means comprises at least one fluid actuated cylinder supported on one end on at least one of said pivoted supporting members and operatively connected at the other end to at least one of said boom members.

14. A mobile loader according to claim 13 in which said load supporting means comprises a carriage having a pair of forwardly extending tines, a pair of vertical supports for said tines, and supporting brackets carried by said vertical supports operable to be secured to said boom members for pivotal movement thereon, and including third actuating means comprising at least one fluid actuated cylinder supported on one end on at least one of said boom members and operatively connected at the other end to at least one of said carriage supporting brackets and operable to pivot the same.

15. A mobile loader according to claim 13 in which said load supporting means includes means for securing a load thereon, and fourth actuating means comprising at least one fluid actuated cylinder supported on said load supporting means for actuating said load securing means.

16. A mobile loader according to claim 13 in which said load supporting means comprises a carriage with a pair of forwardly extending tines, a pair of vertical supports for said tines, and supporting brackets carried by said vertical supports operable to be secured to said boom members for pivotal movement thereon, and including means for securing a load on said carriage, third actuating means comprising at least one fluid actuated cylinder supported on one end on at least one of said boom members and operatively connected at the other end to at least one of said carriage supporting brackets and operable to pivot the same, and fourth actuating means comprising at least one fluid actuated cylinder supported on said load supporting carriage for actuating said load securing means.

17. A mobile loader according to claim 16 in which said load securing means comprises load securing members pivotally supported on said vertical supports and movable into and out of securing relation to said tines, and said fourth actuating means comprising at least one fluid actuated cylinder supported on one end on at least one of said said vertical supports and operatively connected at the other end to at least one of said load securing members for moving the same into and out of load securing position.

* * * * *